US011653165B2

(12) United States Patent
Shirakihara et al.

(10) Patent No.: US 11,653,165 B2
(45) Date of Patent: May 16, 2023

(54) SOUND SIGNAL OUTPUT METHOD AND SOUND SIGNAL OUTPUT DEVICE

(71) Applicant: YAMAHA CORPORATION, Hamamatsu (JP)

(72) Inventors: Futoshi Shirakihara, Hamamatsu (JP); Tadashi Morikawa, Hamamatsu (JP); Kentaro Noto, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/194,509

(22) Filed: Mar. 8, 2021

(65) Prior Publication Data

US 2021/0306787 A1 Sep. 30, 2021

(30) Foreign Application Priority Data

Mar. 24, 2020 (JP) ..... JP2020-052824

(51) Int. Cl.
*H04S 7/00* (2006.01)

(52) U.S. Cl.
CPC ..... *H04S 7/302* (2013.01)

(58) Field of Classification Search
None
See application file for complete search history.

(56) References Cited

U.S. PATENT DOCUMENTS 8,442,239 B2 * 5/2013 Bruelle-Drews .... H04B 1/3822 381/86
9,723,418 B2 8/2017 Bender
10,609,484 B2 3/2020 Family
2005/0195999 A1 9/2005 Takemura
2011/0013790 A1 * 1/2011 Hilpert ..... G10L 19/008 381/300
2014/0119581 A1 5/2014 Tsingos
2015/0358756 A1 * 12/2015 Harma ..... H04S 7/302 381/17

(Continued)

FOREIGN PATENT DOCUMENTS

CN 103650539 A 3/2014
CN 107148782 A 9/2017
JP 2017041897 A 2/2017

(Continued)

OTHER PUBLICATIONS

Extended European search report issued in European Appln. No. 21160960.7 dated Aug. 13, 2021.

(Continued)

*Primary Examiner* — Paul W Huber
(74) *Attorney, Agent, or Firm* — Rossi, Kimms & McDowell LLP

(57) ABSTRACT

A sound signal output method of outputting sound to a plurality of areas comprises obtaining a sound signal of a sound source, receiving a setting of reproduction information indicating whether or not to output the sound signal of the above-mentioned sound source to each of the plurality of areas where the above-mentioned sound signal is to be output, and outputting the above-mentioned reproduction information and the above-mentioned sound signal, or reproducing the above-mentioned sound signal based on the above-mentioned reproduction information.

9 Claims, 12 Drawing Sheets

(56) References Cited

U.S. PATENT DOCUMENTS

| | | | | |
|---|---|---|---|---|
| 2018/0332421 | A1* | 11/2018 | Torres | H04S 3/008 |
| 2020/0145779 | A1* | 5/2020 | Robinson | G10L 19/20 |

FOREIGN PATENT DOCUMENTS

| | | | |
|---|---|---|---|
| WO | 2015127082 | A1 | 8/2015 |
| WO | 2016048381 | A1 | 3/2016 |

OTHER PUBLICATIONS

Office Action issued in European Appln. No. 21160960.7 dated Aug. 8, 2022.
Office Action issued in Chinese Appln. No. 202110260935.3 dated Jul. 18, 2022. English machine translation provided.
Communication Pursuant to Article 94(3) EPC issued in European Appln. No. 21160960.7 dated Feb. 27, 2023.

* cited by examiner

| Sound Source | Zone | | |
|---|---|---|---|
| | Z1 | Z2 | Z3 |
| 1 | ✓ | ✓ | ✓ |
| 2 | ✓ | | |
| 3 | | ✓ | |

FIG.4

| SP | Zone | | |
|---|---|---|---|
| | Z1 | Z2 | Z3 |
| 501 | ✓ | | ✓ |
| 502 | ✓ | | ✓ |
| 503 | ✓ | | ✓ |
| 504 | ✓ | | ✓ |
| 505 | | ✓ | ✓ |
| 506 | | ✓ | ✓ |
| 507 | | ✓ | ✓ |
| 508 | | ✓ | ✓ |
| 509 | | ✓ | ✓ |
| 510 | ✓ | | ✓ |
| 511 | ✓ | | ✓ |
| 512 | | ✓ | ✓ |
| 513 | | ✓ | ✓ |
| 514 | ✓ | | ✓ |
| 515 | ✓ | | ✓ |
| 516 | ✓ | | ✓ |
| 517 | ✓ | | ✓ |
| 518 | | ✓ | ✓ |
| 519 | | ✓ | ✓ |
| 520 | | ✓ | ✓ |
| 521 | | ✓ | ✓ |

FIG.5

| SP | Zone | | |
|---|---|---|---|
| | Z1 | Z2 | Z3 |
| 501 | ✓ | | ✓ |
| 502 | ✓ | | |
| 503 | ✓ | | |
| 504 | ✓ | | |
| 505 | | ✓ | |
| 506 | | ✓ | |
| 507 | | ✓ | |
| 508 | | ✓ | |
| 509 | | ✓ | ✓ |
| 510 | ✓ | | |
| 511 | ✓ | | |
| 512 | | ✓ | |
| 513 | | ✓ | |
| 514 | ✓ | | ✓ |
| 515 | ✓ | | |
| 516 | ✓ | | |
| 517 | ✓ | | |
| 518 | | ✓ | |
| 519 | | ✓ | |
| 520 | | ✓ | |
| 521 | | ✓ | ✓ |

FIG.6

| SP | Zone | | |
|---|---|---|---|
| | Z1 | Z2 | Z3 |
| 501 | ✓ | | ✓ |
| 502 | ✓ | | ✓ |
| 503 | ✓ | | ✓ |
| 504 | | ✓ | ✓ |
| 505 | | ✓ | ✓ |
| 506 | | ✓ | ✓ |
| 507 | | ✓ | ✓ |
| 508 | | ✓ | ✓ |
| 509 | | ✓ | ✓ |
| 510 | ✓ | | ✓ |
| 511 | | ✓ | ✓ |
| 512 | | ✓ | ✓ |
| 513 | | ✓ | ✓ |
| 514 | ✓ | | ✓ |
| 515 | ✓ | | ✓ |
| 516 | ✓ | | ✓ |
| 517 | | ✓ | ✓ |
| 518 | | ✓ | ✓ |
| 519 | | ✓ | ✓ |
| 520 | | ✓ | ✓ |
| 521 | | ✓ | ✓ |

FIG.7

| Sound Source | Zone | | | Position | | |
|---|---|---|---|---|---|---|
| | Z1 | Z2 | Z3 | x | y | z |
| 1 | ✓ | ✓ | ✓ | 2.3 | 1.2 | 2.5 |
| 2 | ✓ | | | * | * | * |
| 3 | | ✓ | | * | * | * |

FIG.9

| SP | Zone | | | Position | | |
|---|---|---|---|---|---|---|
| | Z1 | Z2 | Z3 | x | y | z |
| 501 | ✓ | | ✓ | 0.1 | 0.5 | 5.1 |
| 502 | ✓ | | ✓ | * | * | * |
| 503 | ✓ | | ✓ | * | * | * |
| 504 | ✓ | | ✓ | * | * | * |
| 505 | | ✓ | ✓ | * | * | * |
| 506 | | ✓ | ✓ | * | * | * |
| 507 | | ✓ | ✓ | * | * | * |
| 508 | | ✓ | ✓ | * | * | * |
| 509 | | ✓ | ✓ | * | * | * |
| 510 | ✓ | | ✓ | * | * | * |
| 511 | ✓ | | ✓ | * | * | * |
| 512 | | ✓ | ✓ | * | * | * |
| 513 | | ✓ | ✓ | * | * | * |
| 514 | ✓ | | ✓ | * | * | * |
| 515 | ✓ | | ✓ | * | * | * |
| 516 | ✓ | | ✓ | * | * | * |
| 517 | ✓ | | ✓ | * | * | * |
| 518 | | ✓ | ✓ | * | * | * |
| 519 | | ✓ | ✓ | * | * | * |
| 520 | | ✓ | ✓ | * | * | * |
| 521 | | ✓ | ✓ | * | * | * |

FIG.10

SOUND SIGNAL OUTPUT METHOD AND SOUND SIGNAL OUTPUT DEVICE

CROSS REFERENCE TO RELATED APPLICATIONS

This Nonprovisional application claims priority under 35 U.S.C. § 119(a) on Patent Application No. 2020-052824 filed in Japan on Mar. 24, 2020 the entire contents of which are hereby incorporated by reference.

BACKGROUND

1. Technical Field

One embodiment of the present application relates to a sound signal output method and a sound signal output device.

2. Background Information

Unexamined Japanese Patent Publication No. 2017-41897 discloses a device capable of specifying a localization position of a sound source at any optional position within an area to which a sound signal is outputted.

SUMMARY

The device disclosed in Unexamined Japanese Patent Publication No. 2017-41897 does not consider the case where a plurality of areas to which a sound signal is outputted are provided. For instance, a user may desire to output each of sound signals of different sound sources to the corresponding one of a first area and a second area.

An object of one embodiment of the present application is to provide a sound signal output method and a sound signal output device capable of outputting a sound signal of any optional sound source to each of a plurality of areas.

The sound signal output method of outputting sound to a plurality of areas in accordance with one embodiment of the present application obtains a sound signal of a sound source, receives a setting of reproduction information indicating whether or not to output the sound signal of the above-mentioned sound source to each of the plurality of areas where the above-mentioned sound signal is to be output, and outputs the above-mentioned reproduction information and the above-mentioned sound signal or reproduces the above-mentioned sound signal based on the above-mentioned reproduction information.

According to one embodiment of the present application, a sound signal of any optional sound source can be outputted to each of a plurality of areas.

BRIEF DESCRIPTION OF THE DRAWINGS

FIG. 4 is a view showing an example of reproduction information.

FIG. 5 is a view showing an example of the reproduction information.

FIG. 6 is a view showing an example of the reproduction information.

FIG. 7 is a view showing an example of the reproduction information.

FIG. 9 is a view showing an example of reproduction information.

FIG. 10 is a view showing an example of the reproduction information.

DETAILED DESCRIPTION

Figure 1:
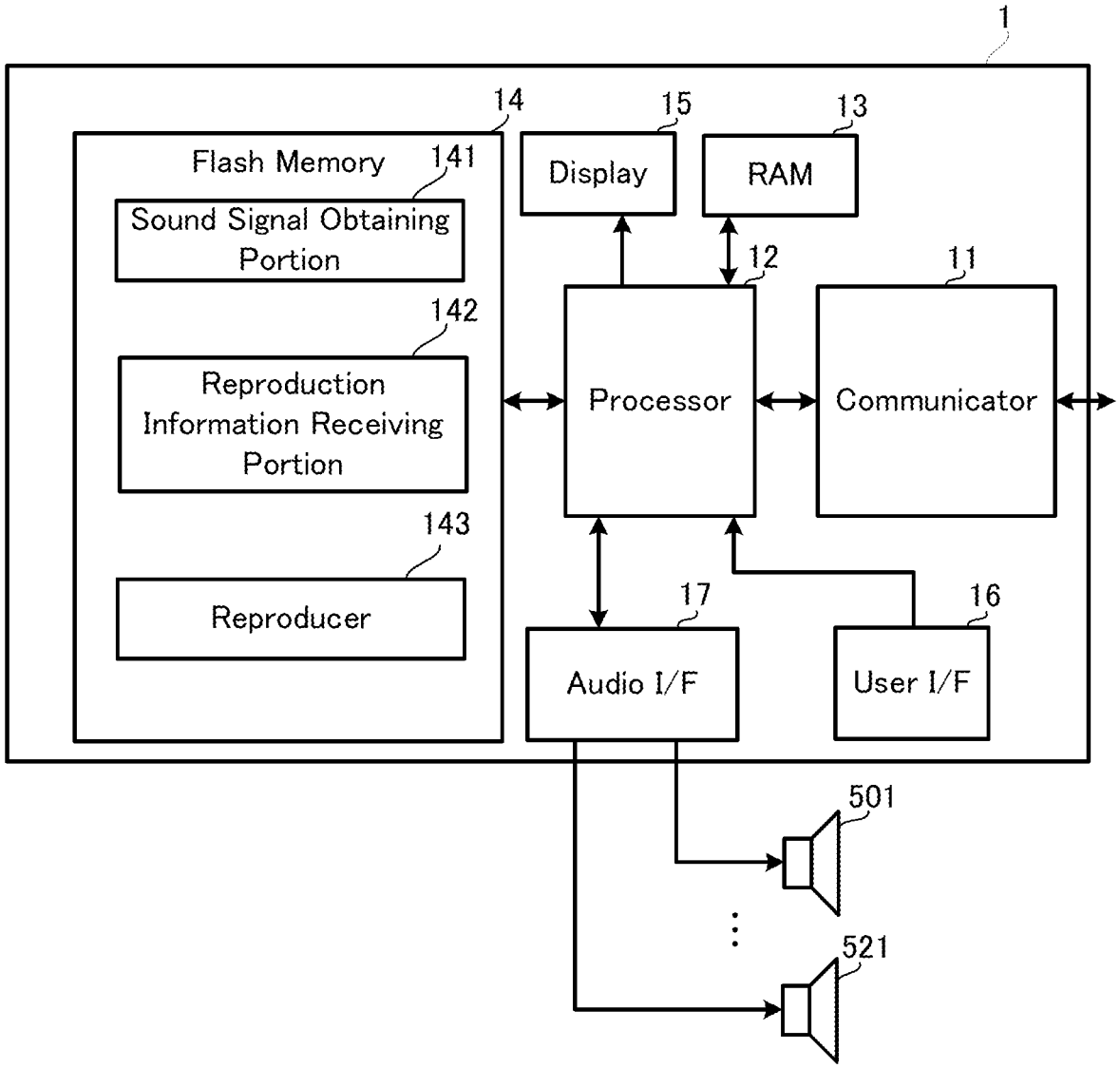
FIG. 1 is a block diagram showing a configuration of a sound signal output device 1.

FIG. 1 is a block diagram showing a configuration of a sound signal output device 1. The sound signal output device 1 includes a communicator 11, a processor 12, a RAM 13, a flash memory 14, a display 15, a user I/F 16, and an audio I/F 17.

The sound signal output device 1 is constituted by a personal computer, a smart phone, a tablet computer, or the like. Further, audio equipment such as an audio mixer is also an example of the sound signal output device.

The communicator 11 communicates with other devices such as a server. The communicator 11, for example, has a wireless-communication function such as Bluetooth (registered trademark) or Wi-Fi (registered trademark), a cable-communication function such as a USB or a LAN, or the like. The communicator 11 receives a sound signal of a sound source, for example.

Figure 3:
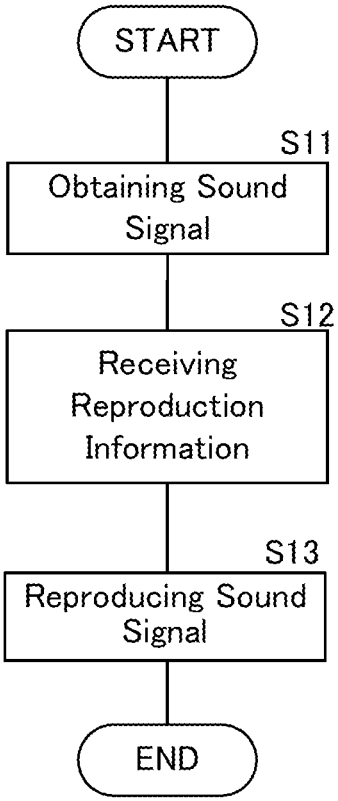
FIG. 3 is a flowchart showing an operation of the sound signal output device 1.

The processor 12 is constituted by a CPU, a DSP, an SoC (System on a Chip), or the like. The processor 12 reads out a program from the flash memory 14 serving as a storage medium, and temporarily stores it in the RAM 13 to execute various kinds of operations. By using the program which has been read out, the processor 12 achieves functional configurations such as a sound signal obtaining portion 141, a reproduction information receiving portion 142, and a reproducer 143. The sound signal obtaining portion 141, the reproduction information receiving portion 142, and the reproducer 143 execute processes S11, S12, and S13 shown in a flowchart of FIG. 3, respectively. Note that, the program needs not to be stored in the flash memory 14. For instance, the processor 12 may download the program from other devices such as a server, and temporarily store it in the RAM 13, if necessary.

The display 15 is constituted by an LCD, or the like. The display 15 displays a setting screen of the reproduction information as shown in FIG. 4, for example.

The user I/F 16 is an example of an operation portion. The user I/F 16 is constituted by a mouse, a keyboard, a touch panel, or the like. The user I/F 17 receives an operation of a user. Note that, the touch panel may be laminated on the display 15.

The audio I/F 17 is constituted by an analog audio terminal, a digital audio terminal, or the like. The audio I/F 17 is connected to a plurality of speakers 501 through 521. The reproducer 143 of the processor 12 outputs a sound signal to the plurality of speakers 501 through 521 via the audio I/F 17.

The sound signal obtaining portion 141 of the processor 12 obtains the sound signal of the sound source, which has been received via the communicator 11 (S11). Further, the sound signal of the sound source may be obtained via the audio I/F 17, rather than the communicator 11. Further, the sound signal of the sound source may be stored in the flash memory 14.

Figure 2:
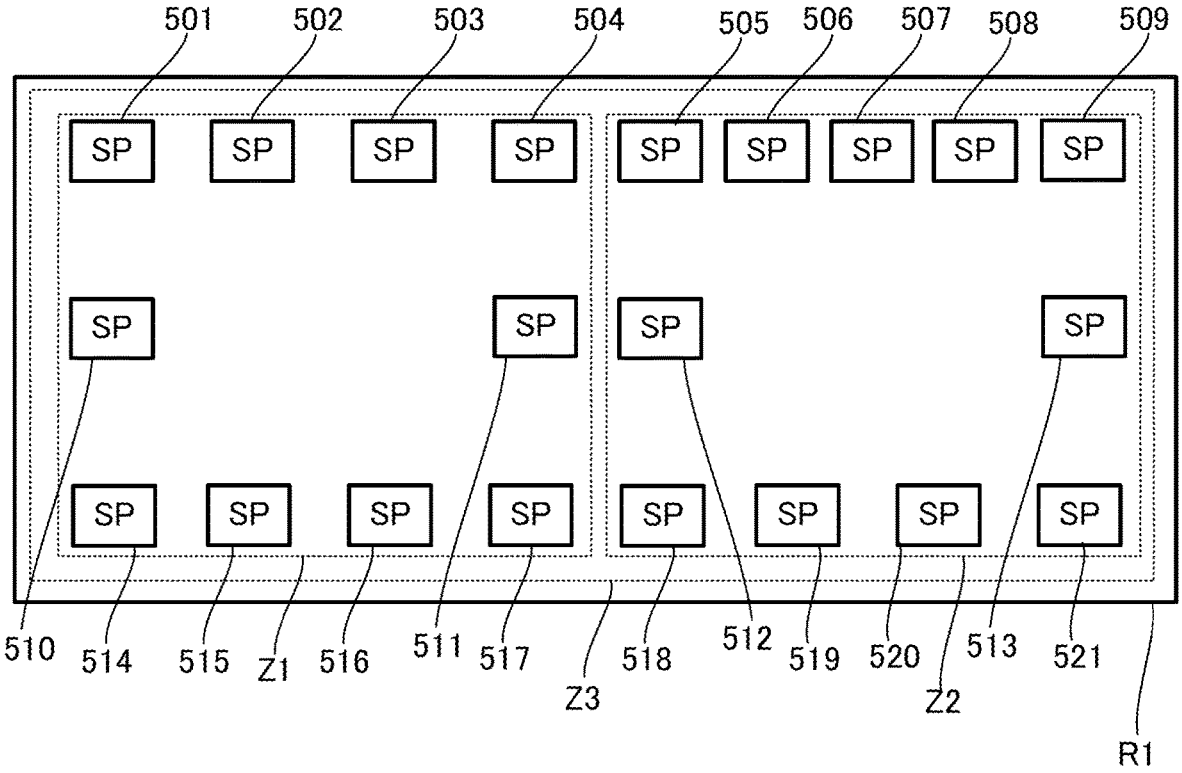
FIG. 2 is a plan view showing an arrangement of speakers in a room, serving as an example of a sound space, and a concept of an area.

FIG. 2 is a plan view showing an arrangement of speakers in a room, serving as an example of a sound space, and a concept of an area. A room R1 has a rectangular shape when viewed in plan view, as an example. In the room R1, a plurality of speakers 501 through 521 are disposed. The speakers 501 through 509 are arranged side by side along a first long side of the room R1 when viewed in plan view. The speakers 514 through 521 are arranged side by side along a second long side of the room R1 when viewed in plan view. The speaker 510 is disposed on a first short side of the room R1 when viewed in plan view. The speaker 513 is disposed on a second short side of the room R1 when viewed in plan view. The speakers 511 and 512 are disposed near the center of the room R1 when viewed in plan view.

The room R1 has a plurality of areas. In the example of FIG. 2, the room R1 has a first area Z1, a second area Z2, and a third area Z3. Each of the areas Z1, Z2, and Z3 is an area to which a sound signal is outputted. Note that, in this example, the plurality of areas Z1, Z2, and Z3 are disposed in the room R1. However, it is not limited that an area to which a sound signal is outputted is located indoors. The area may be located outdoors.

In the example of FIG. 2, the area Z1 is constituted by the speakers 501 through 504, the speakers 510 and 511, and the speakers 514 through 517. Further, the area Z2 is constituted by the speakers 505 through 509, the speakers 512 and 513, and the speakers 518 through 521. Further, the area Z3 is constituted by all the speakers 501 through 521.

The sound signal output device 1 receives a setting of reproduction information indicating which sound source's sound signal should be outputted to each of the plurality of areas (S12).

FIG. 4 is a view showing an example of reproduction information. As shown in FIG. 4, the reproduction information is information indicating to which area a sound signal is outputted for each sound source. In other words, the reproduction information is information indicating which sound source's sound signal is outputted for each area. The processor 12 displays the reproduction information on the display 15. A user edits the reproduction information using the user I/F 16. A user specifies an area to which a sound signal is outputted for each sound source. In other words, a user specifies which sound source's sound signal to be outputted to each of a plurality of areas.

In the example of FIG. 4, sound signals of the sound source 1 and the sound source 2 are outputted to the area Z1. Sound signals of the sound source 1 and the sound source 3 are outputted to the area Z2. The sound signal of the sound source 1 is outputted to the area Z3. In other words, the sound signal of sound source 1 is outputted to all the areas. The sound signal of the sound source 2 is outputted to only the area Z1. The sound signal of the sound source 3 is outputted to only the area Z2. After a user completes the edit, the reproducer 143 of the processor 12 reproduces the sound signal of each sound source based on the reproduction information (S13).

The reproducer 143 outputs the sound signal of the sound source 1 to all the speakers 501 through 521. This enables that the sound of sound source 1 can be heard at any position in the area Z3. The reproducer 143 outputs the sound signal of the sound source 2 to the speakers 501 through 504, the speakers 510 and 511, and the speakers 514 through 517 in the area Z1. This enables that the sound of sound source 2 can be heard at a position in the area Z1. The reproducer 143 outputs the sound signal of the sound source 3 to the speakers 505 through 509, the speakers 512 and 513, and the speakers 518 through 521 in the area Z2. This enables that the sound of sound source 3 can be heard at a position in the area Z2.

In this way, the sound signal output device 1 can output a sound signal of any optional sound source to each of a plurality of areas. For instance, in an attraction of a theme park, a user can use the sound signal output device 1 to reproduce sound of footsteps, as the sound source 1, in all the areas. Therefore, an attraction user hears the footsteps at any position in the attraction. Further, with respect to each attraction object, a user can use the sound signal output device 1 to reproduce sounds while specifying an area. Thus, an attraction user can hear sounds of different objects in each of areas, while hearing the same sound (for example, footsteps) in all the areas of the attraction.

Note that, the reproducer 143 may perform sound-image localization processing in which a sound image of each sound source is localized in the corresponding area. In this case, the reproducer 143 obtains position information that indicates the location of each speaker disposed in the plurality of areas. The position information of speakers may be stored in the flash memory 14, or a user may input it, as necessary, by using the sound signal output device 1. The reproducer 143 calculates a level balance of sound signals to be outputted to the plurality of speakers such that each sound source's sound signal is localized in the corresponding area based on the position information of speakers, and adjusts a level of each of the sound signals. Further, the reproducer 143 may adjust output timing of each of sound signals to be outputted to the plurality of speakers such that each sound source's sound signal is localized in the corresponding area. This can reduce the possibility that the sound outputted to each area is leaked to other areas and made audible.

Note that, the reproducer 143 is not necessary to output a sound signal of each sound source to all the speakers each of which is disposed in the corresponding area. For instance, the reproducer 143 may output a sound signal of the sound source 1 to the speakers 501, 509, 514, and 521 which are located at four corners of the room R1.

FIG. 5 is a view showing an example of reproduction information in accordance with a modification 1. As shown in FIG. 5, the reproduction information may include information indicating to which area a sound signal is outputted for each speaker. In other words, the reproduction information includes speaker specification information that specifies at least one speaker to be used in each of a plurality of areas.

In the example of FIG. 5, the speakers 501 through 504, the speakers 510 and 511, and the speakers 514 through 517 are used in the area Z1. The speakers 505 through 509, the speakers 512 and 513, and the speakers 518 through 521 are used in the area Z2. All the speakers 501 through 521 are used in the area Z3.

On the other hand, as shown in FIG. 6, a user may specify the speakers 501, 509, 514, and 521, as speakers to be used in the area Z3. In this case, the reproducer 143 outputs a sound signal of the sound source specified in the area Z3 (sound signal of the sound source 1 in the example of FIG. 4) to the speakers 501, 509, 514, and 521 that are located at four corners of the room R1. Even in this case, the area Z3 still corresponds to the entire of the room R1. Therefore, a user can use sound signal output device 1 to reproduce sound of footsteps, as the sound source 1, in all the areas of the attraction in a theme park, for example.

On the other hand, as speakers to be used in the area Z1, a user specifies the speakers 501 through 503, the speaker 510, and the speakers 514 through 516 in the example of FIG. 7. Further, as speakers to be used in the area Z2, a user specifies the speakers 504 through 509, the speakers 511, 512, and 513, and the speakers 517 through 521.

Figure 8:
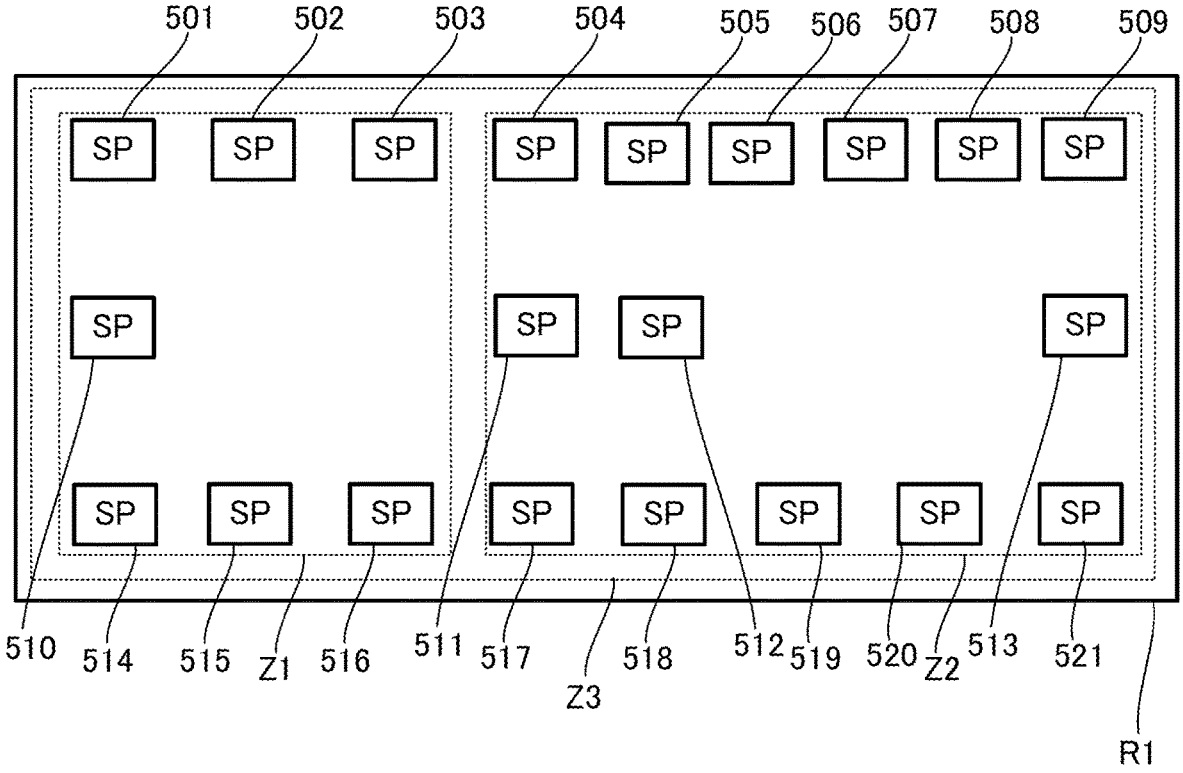
FIG. 8 is a plan view showing an arrangement of speakers in a room, serving as an example of sound space, and a concept of an area.

When a user specifies the speakers as shown in FIG. 7, the reproducer 143 outputs a sound signal of the sound source specified in the area Z1 (the sound source 1 and the sound source 2 in the example of FIG. 4) to the speakers 501 through 503, the speaker 510, and the speakers 514 through 516, as shown in FIG. 8. Further, the reproducer 143 outputs a sound signal of the sound source specified in the area Z2 (the sound source 1 and the sound source 3 in the example of FIG. 4) to the speakers 504 through 509, the speakers 511, 512, and 513, and the speakers 517 through 521.

Thus, a sound of the sound source 2 is reproduced in the area where the speakers 501 through 503, the speaker 510, and the speakers 514 through 516 are disposed. A sound of the sound source 3 is reproduced in the area where the speakers 504 through 509, the speakers 511, 512, and 513, and the speakers 517 through 521 are disposed. In other words, the ranges covered by the areas Z1 and Z2 are changed.

In this way, by specifying speakers to be used in each area, a user can easily change a range covered by each area.

FIG. 9 is a view showing an example of reproduction information in accordance with a modification 2. As shown in FIG. 9, the reproduction information may include localization information that specifies a localization position of a sound source. The localization information is three-dimensional coordinates whose origin is located at a predetermined position of the room R1, for example. In the example of FIG. 9, the localization information is three-dimensional coordinates, but may be two-dimensional (plan) coordinates.

The reproducer 143 calculates a level balance of sound signals to be outputted to the plurality of speakers such that a sound image of each sound source is localized at the corresponding position based on the localization information and the position information of speakers, and adjusts a level of each of the sound signals. The position information of speakers may be stored in the flash memory 14 as mentioned above, or a user may input it, as necessary, by using the sound signal output device 1. Further, the reproducer 143 may adjust output timing of each of sound signals to be outputted to the plurality of speakers such that each sound source's sound signal is localized at the corresponding position. Thus, for instance, a user can use the sound signal output device 1 to localize a sound image at a position intended by the user, for each attraction object.

FIG. 10 is a view showing an example of reproduction information in accordance with a modification 3. As shown in FIG. 10, the reproduction information may include position information that specifies the location of each speaker. The position information of speakers shown in FIG. 10 is also three-dimensional coordinates whose origin is located at a predetermined position in the room R1, for example. In the example of FIG. 10, the position information of speakers is three-dimensional coordinates, but may be two-dimensional (plan) coordinates. When the location of each speaker is changed, a user uses sound signal output device 1 to edit the position information of speakers, which is included in the reproduction information. Accordingly, when performing the sound-image localization processing of each sound source, the reproducer 143 calculates a level balance of sound signals to be outputted to the plurality of speakers based on the edited position information of speakers, and adjusts a level of each of the sound signals.

Alternatively, if a speaker is disposed additionally or removed, a user may use the sound signal output device 1 to add or remove the speaker to or from the reproduction information.

Accordingly, even if the location of each speaker is changed, a user can use the sound signal output device 1 to reproduce the sound of each sound source at a localization position and in an area intended by the user.

Figure 11:
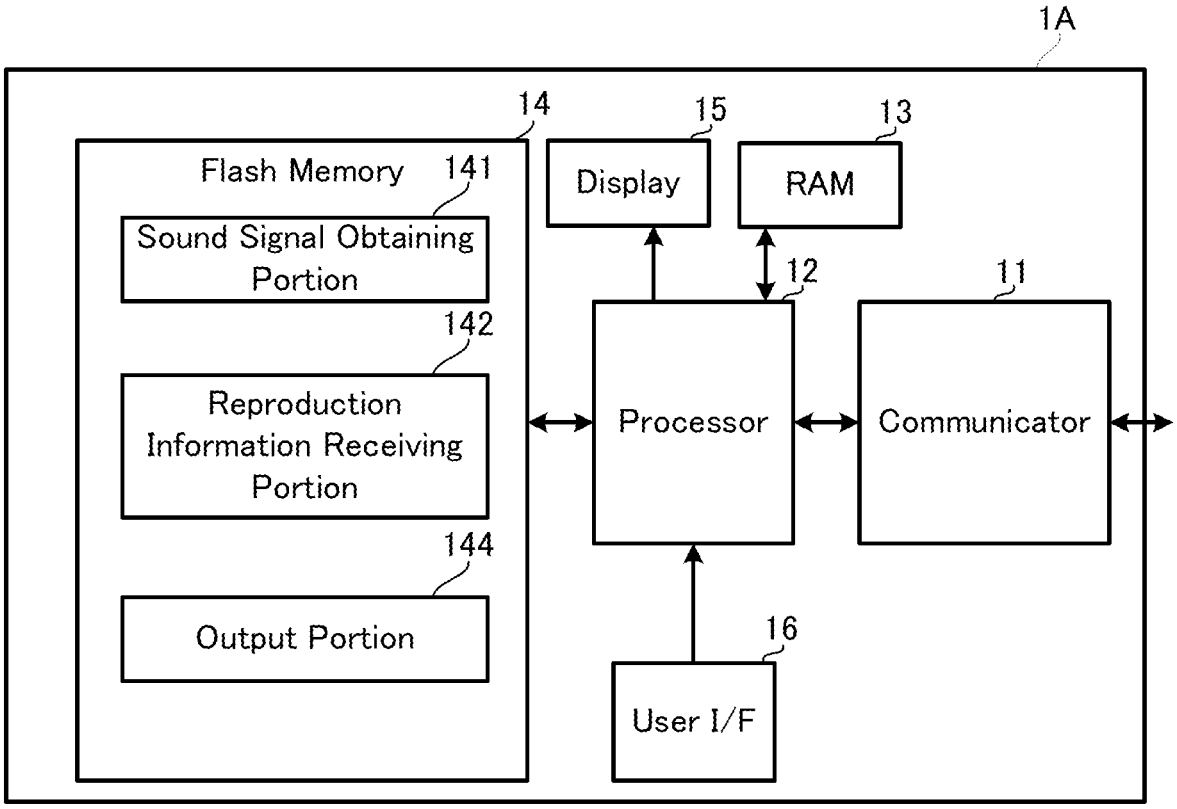
FIG. 11 is a block diagram showing a configuration of a sound signal output device 1A.
Figure 12:
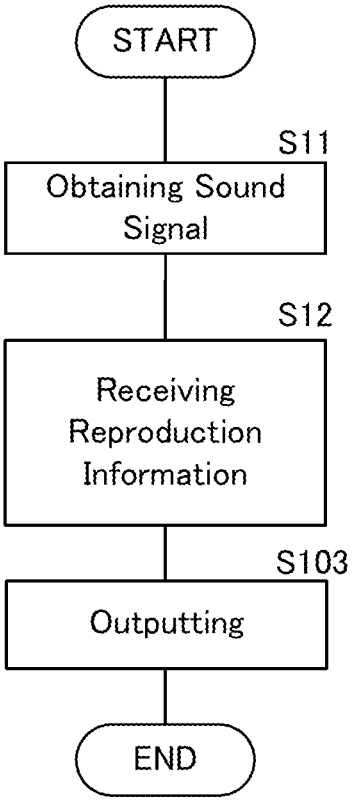
FIG. 12 is a flowchart showing an operation of the sound signal output device 1A.

Next, FIG. 11 is a block diagram showing a configuration of a sound signal output device 1A. The same reference numerals are assigned to the same configurations in the sound signal output device 1 of FIG. 1, and the description thereof is omitted. FIG. 12 is a flowchart showing an operation of the sound signal output device 1A. The same reference numerals are assigned to the same processing in the flowchart of FIG. 3, and the description thereof is omitted.

Unlike the sound signal output device 1, the audio I/F 17 is not included in the sound signal output device 1A. Further, instead of a function of the reproducer 143, an output portion 144 is included in the processor 12. The sound signal output device 1A is also constituted by a personal computer, a smart phone, a tablet computer, or the like. Further, audio equipment, such as an audio mixer, is also an example of the sound signal output device.

Like the sound signal output device 1, the sound signal output device 1A receives an edit of reproduction information. In other words, in the sound signal output device 1A, the reproduction information shown in FIGS. 4 through 7 and FIGS. 9 and 10 is displayed on the display 15, and the edit of reproduction information is received from a user via the user I/F 16.

After a user completes the edit, the output portion 144 of the processor 12 outputs reproduction information and a sound signal (S103). The sound signal and the reproduction information may be outputted to the flash memory 14 and stored therein, or may be outputted to other devices, such as a server, via the communicator 11.

After obtaining the reproduction information and the sound signal, the device reproduces the sound signal of each sound source based on the reproduction information, like the reproducer 143 shown in FIG. 1.

In this way, assuming a reproduction environment, a user can use the sound signal output device 1A to produce reproduction information that specifies to which area of a plurality of areas a sound signal is outputted for each sound source. In other words, by using the sound signal output device 1A, a user can produce the reproduction information in advance, which is different from the sound signal output device 1 used in an attraction of a theme park or the like, for example. In this case, a user may also use the sound signal output device 1 to edit the reproduction information, which is produced in advance by using the sound signal output device 1A, so as to match an actual environment.

The description of the present embodiments is illustrative in all respects and is not to be construed restrictively. The scope of the present application is indicated by the appended claims rather than by the above-mentioned embodiments. Furthermore, the scope of the present application includes the scope of the claims and a range equivalent thereto.

What is claimed is:

1. A sound signal output method of outputting sound to a plurality of areas in a sound space by a plurality of speakers in the sound space, the method comprising:

obtaining any of a first sound signal of a first sound source, a second sound signal of a second sound source, and a third sound signal of a third sound source;

receiving a setting of reproduction information indicating whether or not to output at least one obtained sound signal, among the first sound signal, the second sound signal, and the third sound signal, of the respective sound source to each of the plurality of areas in the sound space where the respective sound signal is to be output, the plurality of areas in the sound space including at least:

a first area corresponding to first part of the sound space and including a first plurality of speakers, among the plurality of speakers in the sound space; and a second area corresponding to second part of the sound space and including a second plurality of speakers different from the first plurality of speakers, among the plurality of speakers in the sound space; and outputting the reproduction information and any of the first, second, and third sound signals, or reproducing any of the first, second, and third sound signals based on the reproduction information, wherein:

in a state where the second sound signal is indicated to be output to only the first area, the second sound signal is output to only the first plurality of speakers, or in reproducing the second sound signal the second sound signal is output to only the first plurality of speakers, so that the output sound of the second sound signal is localized only to the first area, in a state where the third sound signal is indicated to be output to only the second area, the third sound signal is output to only the second plurality of speakers, or in reproducing the third sound signal the third sound signal is output to only the second plurality of speakers, so that the output sound of the third sound signal is localized only to the second area, the reproduction information includes:

position information indicating locations of the respective plurality of speakers disposed in the plurality of areas; and localization information indicating a localization position of each of the first, second, and third sound sources, and the position information and the localization information provides, in reproducing sound from any of the first, second, and third sound signals, balance adjustment information of the first plurality of speakers, the second plurality of speakers, or the plurality of speakers.

2. The sound signal output method according to claim 1, wherein the reproduction information includes speaker specification information specifying the respective plurality of speakers to be used in each of the plurality of areas.

3. The sound signal output method according to claim 1, wherein:

the plurality of areas in the sound space include a third area corresponding to an entirety of the sound space and including all of the plurality of speakers, and the outputting outputs, in a state where the first sound signal is indicated to be output to the third area, the first sound signal to all of the plurality of speakers in the sound space.

4. A sound signal output device for outputting sound to a plurality of areas in a sound space by a plurality of speakers in the sound space, the sound signal output device comprising:

a memory storing instructions; and a processor that implements the instructions to:

obtain any of a first sound signal of a first sound source, a second sound signal of a second sound source, and a third sound signal of a third sound source;

receive a setting of reproduction information indicating whether or not to output at least one obtained sound signal, among the first sound signal, the second sound signal, and the third sound signal, of the respective sound source to each of the plurality of areas in the sound space where the respective sound signal is to be output, the plurality of areas in the sound space including at least:

a first area corresponding to first part of the sound space and including a first plurality of speakers, among the plurality of speakers in the sound space; and a second area corresponding to second part of the sound space and including a second plurality of speakers different from the first plurality of speakers, among the plurality of speakers in the sound space; and output the reproduction information and any of the first, second, and third sound signals, wherein:

in a state where the second sound signal is indicated to be output to only the first area, the second sound signal is output to only the first plurality of speakers so that the output sound of the second sound signal is localized only to the first area, in a state where the third sound signal is indicated to be output to only the second area, the third sound signal is output to only the second plurality of speakers so that the output sound of the third sound signal is localized only to the second area, the reproduction information includes:

position information indicating locations of the respective plurality of speakers disposed in the plurality of areas; and localization information indicating a localization position of each of the first, second, and third sound sources, and the position information and the localization information provides, in reproducing sound from any of the first, second, and third sound signals, balance adjustment information of the first plurality of speakers, the second plurality of speakers, or the plurality of speakers.

5. The sound signal output device according to claim 4, wherein the reproduction information includes speaker specification information specifying the respective plurality of speakers to be used in each of the plurality of areas.

6. The sound signal output device according to claim 4, wherein:

the plurality of areas in the sound space include a third area corresponding to an entirety of the sound space and including all of the plurality of speakers, and the processor outputs, in a state where the first sound signal is indicated to be output to the third area, the first sound signal to all of the plurality of speakers in the sound space.

7. A sound signal output device for outputting sound to a plurality of areas in a sound space by a plurality of speakers in the sound space, the sound signal output device comprising:

a memory storing instructions; and a processor that implements the instructions to:

obtain any of a first sound signal of a sound source, a second sound signal of a second sound source, and a third sound signal of a third sound source;

receive a setting of reproduction information indicating whether or not to output at least one obtained sound signal, among the first sound signal, the second sound signal, or the third sound signal, of the respective sound source to each of the plurality of areas in the sound space where the sound signal is to be output, the plurality of areas in the sound space including at least:

a first area corresponding to first part of the sound space and including a first plurality of speakers, among the plurality of speakers in the sound space; and a second area corresponding to second part of the sound space and including a second plurality of speakers different from the first plurality of speakers, among the plurality of speakers in the sound space; and reproduce any of the first, second, and third sound signals based on the reproduction information, wherein:

in a state where the second sound signal is indicated to be output to only the first area, in reproducing the second sound signal, the second sound signal is output to only the first plurality of speakers so that the output sound of the second sound signal is localized only to the first area, in a state where the third sound signal is indicated to be output to only the second area, in reproducing the third sound signal, the third sound signal is output to only the second plurality of speakers so that the output sound of the third sound signal is localized only to the second area, the reproduction information includes:

position information indicating locations of the respective plurality of speakers disposed in the plurality of areas; and localization information indicating a localization position of each of the first, second, and third sound sources, and the position information and the localization information provides, in reproducing sound from any of the first, second, and third sound signals, balance adjustment information of the first plurality of speakers, the second plurality of speakers, or the plurality of speakers.

8. The sound signal output device according to claim 7, wherein the reproduction information includes speaker specification information specifying the respective plurality of speakers to be used in each of the plurality of areas.

9. The sound signal output device according to claim 7, wherein:

the plurality of areas in the sound space include a third area corresponding to an entirety of the sound space and including all of the plurality of speakers, and the processor outputs, in a state where the first sound signal is indicated to be output to the third area, in reproducing the first sound signal, the first sound signal to all of the plurality of speakers in the sound space.

* * * * *